US007673354B2

(12) United States Patent
Fader

(10) Patent No.: US 7,673,354 B2
(45) Date of Patent: Mar. 9, 2010

(54) BABY SLEEPING POUCH METHOD AND APPARATUS

(76) Inventor: Sarath Fader, 11722 84th Ave. NE., Kirkland, WA (US) 98034

( * ) Notice: Subject to any disclaimer, the term of this patent is extended or adjusted under 35 U.S.C. 154(b) by 631 days.

(21) Appl. No.: 11/468,226

(22) Filed: Aug. 29, 2006

(65) Prior Publication Data

US 2007/0061968 A1 Mar. 22, 2007

Related U.S. Application Data

(60) Provisional application No. 60/712,683, filed on Aug. 30, 2005.

(51) Int. Cl.
*A47G 9/04* (2006.01)
*A41B 13/06* (2006.01)
*A61F 5/37* (2006.01)

(52) U.S. Cl. ..... 5/494; 5/496; 5/497; 5/498; 5/499; 5/500; 5/502; 5/485; 2/69.5; 128/873

(58) Field of Classification Search ..... 5/494–500, 5/502, 482, 485; 2/69.5, 69; 128/872, 873; 24/72.5

See application file for complete search history.

(56) References Cited

U.S. PATENT DOCUMENTS

| | | | | |
|---|---|---|---|---|
| 1,403,873 | A | 1/1922 | Scott | |
| 1,964,271 | A | 6/1934 | O'Dwyer | |
| 2,451,807 | A | 10/1948 | Catizone | |
| 2,702,385 | A | 2/1955 | Goldberg | |
| 3,832,744 | A | 9/1974 | Krarun | |
| 3,845,513 | A | 11/1974 | Hubner | |
| 3,872,524 | A | 3/1975 | Hummel | |
| 4,172,300 | A | 10/1979 | Miller | |
| 4,202,052 | A | 5/1980 | Bilanzich | |
| 4,897,885 | A | 2/1990 | Lunt | |
| 5,014,376 | A * | 5/1991 | Doran et al. | 5/603 |
| D422,775 | S | 4/2000 | Hurr | |
| 6,122,783 | A * | 9/2000 | Herndon et al. | 5/496 |
| 6,145,932 | A * | 11/2000 | Hamel-Nyhus et al. | 297/465 |
| 6,513,164 | B1 | 2/2003 | Hearns | |
| 6,631,528 | B2 | 10/2003 | Landry | |
| 6,681,422 | B2 | 1/2004 | Landry | |
| 6,817,048 | B1 | 11/2004 | LaRosa | |
| D501,350 | S | 2/2005 | Kelly | |
| 6,848,131 | B1 | 2/2005 | Landry | |
| 6,857,146 | B2 | 2/2005 | Landry | |
| 6,978,479 | B2 * | 12/2005 | Thach | 2/69.5 |
| 7,111,344 | B2 * | 9/2006 | French | 5/494 |

(Continued)

*Primary Examiner*—Robert G Santos
(74) *Attorney, Agent, or Firm*—Matthew Jellett

(57) ABSTRACT

A resting method and apparatus for a young child. The young child can be either a newborn, infant, or toddler. The resting apparatus will attach to a cushion such as a mattress, or other back supporting device which is generally associated with a crib or other child's sleeping environmental structure. The resting apparatus has a base sheet or cover which attaches to the cushion. On top of the base cover is attached a pouch section. The pouch section is sized to allow the child to fit comfortably within the interior of the pouch from the child's neck to the child's feet. The pouch fits securely against the outer surface area of the child. The child is laid on its back within the pouch. The arms and legs are held in longitudinal alignment within the pouch. The pouch is designed to restrain the child from overturning from its back position to a front facing position.

57 Claims, 6 Drawing Sheets

U.S. PATENT DOCUMENTS

| | | | | |
|---|---|---|---|---|
| 7,370,377 | B2 * | 5/2008 | Landry | 5/494 |
| 7,584,515 | B2 * | 9/2009 | Jones et al. | 5/485 |
| 2002/0108176 | A1 * | 8/2002 | Ragen | 5/482 |
| 2003/0154548 | A1 | 8/2003 | Landry | |
| 2003/0154549 | A1 | 8/2003 | Landry | |
| 2004/0019970 | A1 | 2/2004 | Landry | |
| 2004/0199999 | A1 | 10/2004 | Landry | |
| 2005/0028278 | A1 | 2/2005 | Landry | |
| 2005/0210585 | A1 * | 9/2005 | French | 5/494 |
| 2007/0061968 | A1 * | 3/2007 | Fader | 5/494 |
| 2007/0157392 | A1 * | 7/2007 | Ragen | 5/655 |
| 2009/0056017 | A1 * | 3/2009 | Jones et al. | 5/485 |
| 2009/0113630 | A1 * | 5/2009 | Landry | 5/494 |
| 2009/0217455 | A1 * | 9/2009 | Wilson | 5/494 |

* cited by examiner

BABY SLEEPING POUCH METHOD AND APPARATUS

RELATED APPLICATIONS

This application claims priority benefit of U.S. Ser. No. 60/712,683, filed Aug. 8, 2005.

BACKGROUND a) Field

The present concept deals generally with bedding and coverings for newborn and infant children. For the most part, infants are swaddled using blankets and/or slings of some sort which enable the parents to carry the infant and provide a certain measure of security for the infant; the swaddling blankets mimic the close confines of the womb which the infant has just previously left. The swaddling blankets provide warmth, a sense of security to the infant, and a measure of control, keeping the infant from spontaneously flipping over from a back position to a front position or onto the infant's stomach. Further, there are many reasons to control the position of the infant including prevention of sudden infant death syndrome, quieting the effects of an infant who has colic by keeping the child in an inclined position so that stomach acids stay in the base of the stomach and do not enter into the lower esophagus region, as well as keeping a clear line of sight between the infant and the parent. The following prior art generally discloses toddler or infant bed coverings and/or pouches and the like which either enable the parents to control the infant's position for sleeping at night or provide a transportation carrier of some sort for the child.

b) Background

U.S. Pat. No. 1,403,873 (Scott) discloses a bed covering, and referring to Col. 1 at line 9, relates particularly to bed coverings for infants or toddlers and provides for tucking in of the infant without danger of the infant subsequently being uncovered by movements during sleep. The blanket is constructed of material like woolen blankets, cotton sheeting, flannel or cotton flannel as circumstances may require.

U.S. Pat. No. 1,964,271 (O'Dwyer) discloses a sleeping bag for as referred to Col. 1 at line 14, small infants to prevent the infant from rolling out while sleeping. Further down at the line 40, the bag has an anchoring sheet with fabric straps which can be extended around the underside of the mattress and fastened together to secure the sleeping bag to the mattress. A bag is cut to fit the length and width of the child, with the interior allowing the arms and legs to be extended by the child.

U.S. Pat. No. 2,451,807 (Catizone) discloses an infant's garment where the garment is combined with a sheet covering a mattress. This patent has two main components, the first is a sheet and the second is a jacket, which form the infant garment. The jacket is long enough to cover the infant's waistline, and is connected to the sheet. The sheet is large enough to encompass the entire jacket. The sheet is also large enough to be tucked underneath the mattress or crib bed. The jacket also has neck openings and arm openings, a collar opening.

U.S. Pat. No. 2,702,385 (Goldberg) discloses a baby blanket garment and has a baby blanket which is the top portion of the garment and can be secured to the corners of the crib, the blanket has two arm holes which are slit into the top portion of the blanket. On the back is a baby receiving bag to hold the baby. The baby receiving bag is fastened to the back face of the top blanket and has a zipper which runs around the edge of the baby receiving bag allowing the user to open and close the bag to insert or remove the child.

U.S. Pat. No. 3,832,744 (Krarup) discloses a sheet sleeping bag which has openings for accommodating the neck, head and arms and keeps the person from leaving the bed and throwing the sheets off during sleeping. The base of this sheet sleeping bag is the draw sheet, referred to Col. 2 at line 40, where a single triangular piece of fabric is stitched to the draw piece in a perpendicular relationship, the other edge of the triangular piece of fabric is stitched to the centerline of the back of the sleeping bag also in a perpendicular fashion. The triangular piece of fabric allows the person, or child in this case, to have full freedom of movement to turn on to his or her side, stomach or back but preventing the person from standing or rising. The triangular piece of fabric can be inverted and sewn the other direction allowing the person to sit up but still be prevented from standing out of bed.

U.S. Pat. No. 3,845,513 (Hubner) discloses a safety sleeping bag for infants and babies. It is a zipper opening blanket of resilient material having a bodice like upper portion, and a bag lower portion, secured to a crib mattress by a back portion sewn jointly with soft absorbent filler and a retainer for a disposable diaper connected to a stretchable bed linen sheet with a tension band to encircle the mattress. Further, referring to Col. 3 at line 32, the bodice like upper portion has an armhole on each side and a square neck. A zipper is attached to the front of the bag and extends from square neck to the base area of the bag. The slide of the zipper has a closed position at the base area of the sleeping bag so that the child cannot reach it. The edges of the arm holes are covered with stretchable terrycloth material.

U.S. Pat. No. 3,872,524 (Hummel) discloses a baby cover which is rectangular in configuration and is designed to be placed on a mattress. The baby cover has bands which allow the cover to be secured to the mattress or the crib. A jacket is provided to receive the upper portion of the baby. The jacket has a collar, arm openings, and a zipper. A continuous slit extends from the cover section up into the jacket and is closed by the zipper.

U.S. Pat. No. 4,172,300 (Miller) discloses a pouch zipper blanket and method of constructing and utilizing the same, the zipper blanket has an outer blanket and a pouch member where the pouch is connected to the inside face of the blanket. The pouch is sewn to the blanket around its peripheral edges except for the top edge which is left open. The pouch has a full-length slit with a zipper to open and close the pouch.

U.S. Pat. No. 4,202,052 (Bilanzich) discloses an extendable infant sheet and sleeper where the sheet is designed to keep the infant in the middle of the bed or crib. The sheet has a central pleat which extends along the entire length and is sewed onto the main sheet. The sleeper jacket is attached to the opening across the central pleat to form an integral sleeper unit. The extendable pleat between fixed ends permits the safe movement of the infant without binding the sheet and causing discomfort.

U.S. Pat. No. 4,897,885 (Lunt) discloses a one-piece infant bunting, where the bunting is formed from a single blanket of multiple layer of fabric material and where the perforation of the blanket is ultrasonically welded to create a continuous hem. The blanket is essentially configured to wrap around the child and have a rectangular main section with a lower extension for forming a closure and an upper extension for forming a folded hood over the head of the infant. The sides of the blanket are foldable and overlap the infant's body. Velcro fasteners are provided to close the blanket and keep it in position around the infant.

U.S. Pat. No. 6,513,164 (Hearns) discloses a baby blanket assembly which has a bottom blanket or support portion, a top blanket or a cover portion and the top blanket can be attached to the bottom blanket to form a baby containment pouch. Attached to the pouch is a pacifier and a burping cloth, also a breathing sensor and a sound device or motion sensor.

U.S. Pat. No. 6,817,048 (LaRosa) discloses an infant sleeping pouch where the pouch restrains the movement of the child in a crib therefore reducing the risk of accidental injury or death of the child do to for example Sudden Infant Death Syndrome. The device allows the infant to lie on its back and roll from side to side. The child sits in a pouch and the pouch is then restrained on the mattress. Referring to Col. 3 at line 25, the pouch has a zipper that allows it to be opened so the child can be placed into it. At the top of the pouch there are two flaps having Velcro pads on them so that they can attach to one another. The bottom area of the pouch is large for the child to kick within the pouch and also has shoulder straps and a chest region which are adjustable. The pouch is then connected to a Velcro pad which restraints the child from moving on the mattress. The Velcro pad is secured to the mattress by sewing the connecting pad to the mattress cover itself. The mattress cover is then wrapped around the mattress and or tied to the crib.

US D 422,775 (Hurr) discloses a baby blanket which essentially has what appears to be a pouch section where the baby can fit into the blanket. The baby blanket is configured in a diamond shape with a top triangular cover on the lower portion of the diamond and the top cover connected to the lower diamond portion along the edges of the blanket periphery. The baby can fit into the pouch which is formed from the top cover and bottom cover. US D 501,350 (Kelly) discloses a design for a baby blanket which is configured in a diamond shape and has a small pouch.

U.S. Pat. No. 6,631,528 and US 2003/0154548 discloses a crib safety sheet/blanket which has a fitted sheet with the front surface and a back surface and has two ends to snugly fit the sheet to the mattress. A blanket is sewn along the middle of the fitted sheet and has two blanket halves. The blanket halves are connected together by hook loop and fastening materials such as Velcro, so that the infant can be wrapped by the two halves of the blanket into a supine position. A number of elastic straps can be extended across the bottom of the fitted sheet to be removed or secured to the side of the sheet within the meeting strips of the hook and loop fastening material to contain the sheet on the mattress.

U.S. Pat. No. 6,681,422 and US 2003/0154549 discloses a crib safety sheet blanket with a series of baby sheet sleeping restraining devices including:

First, as seen in paragraph 45, a cloth sac or case which essentially resembles a large pillowcase which will fit over the top end of a bassinet pad or small mattress. The blanket folding portion is sewn on the top surface of the sac.

Second, as seen in FIG. 7 and referring to paragraph 46, a rectangular sheet. A fastening device such as a hook and loop material can also be used to place the hook and loop material. The sheet can then be wrapped around the mattress and secured by the Velcro tight material or a fitted aperture or threaded aperture type of connection. Also, as seen in FIG. 8, the sheet can be connected to a full-size adult mattress where the snap fasteners are anchored to the rails of the bed frame to keep the base sheet in position.

Third, a rectangular sheet which has several straps attached to each end of the sheet and can be wrapped around the mattress or crib and connected using either a hook and loop material or the snap fasteners.

US 2004/0199999 published Oct. 14, 2004 discloses a crib safety sheet with a blanket which is removable from the sheet portion for on moving the child from one surface to another which may have the sheet material to interface with the blanket wrap. Referring to paragraph 53 of the publication, a safety sheet is shown with a detachable blanket. The bottom blanket has a mating fastener to engage the corresponding second portion of the mating fastener connected to the blanket wrap element.

None of the prior art taken either singly or in combination is seen to describe the instant concept as discussed below.

DESCRIPTION OF THE CURRENT EMBODIMENTS

While sleeping in the same room or a different room as their newborn infant, parents will want to reassure themselves that the child is sleeping in a safe position.

Newborn and infant children will generally be sleeping in cribs which may have loose bedding or pillows such as sheets and/or blankets. This bedding can bunch around the infant as it is sleeping, especially around its' breathing space. Recent US Consumer Product Safety Commission warnings have raised concerns regarding the loose bedding in the newborn or infant crib. It has been determined that the bunching of the bedding can cause dangerous rebreathing of carbon dioxide, conceivably hampering an infant's development.

The current embodiment provides a covering for a young child, either a newborn infant, or toddler, which enables the child to stay warm in a comfortable position throughout the sleeping time, and provides a clear field for breathing. The resting assembly enables the parent to place the child in a back prone sleeping position, and reasonably secure the legs and arms from a transverse movement, yet allowing room for movement within the pouch portion of the assembly so that the child does not feel too constrained.

Figure 1:
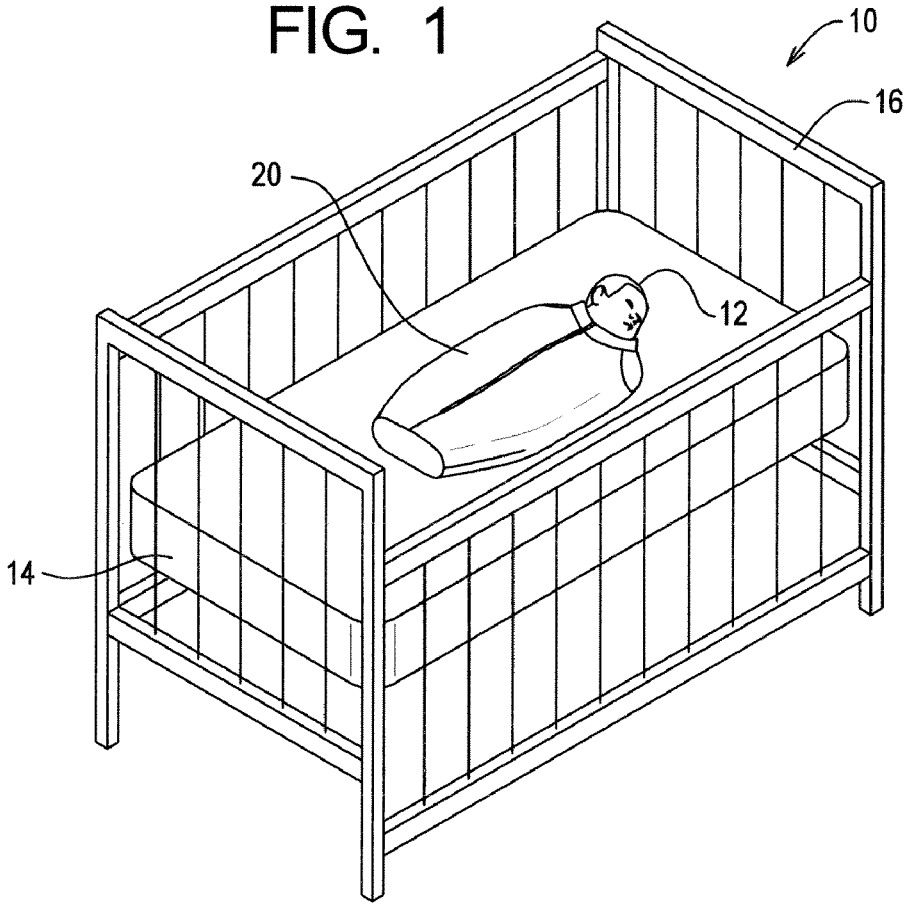
FIG. 1 is a perspective view of a young child's sleeping environment.
Figure 2:
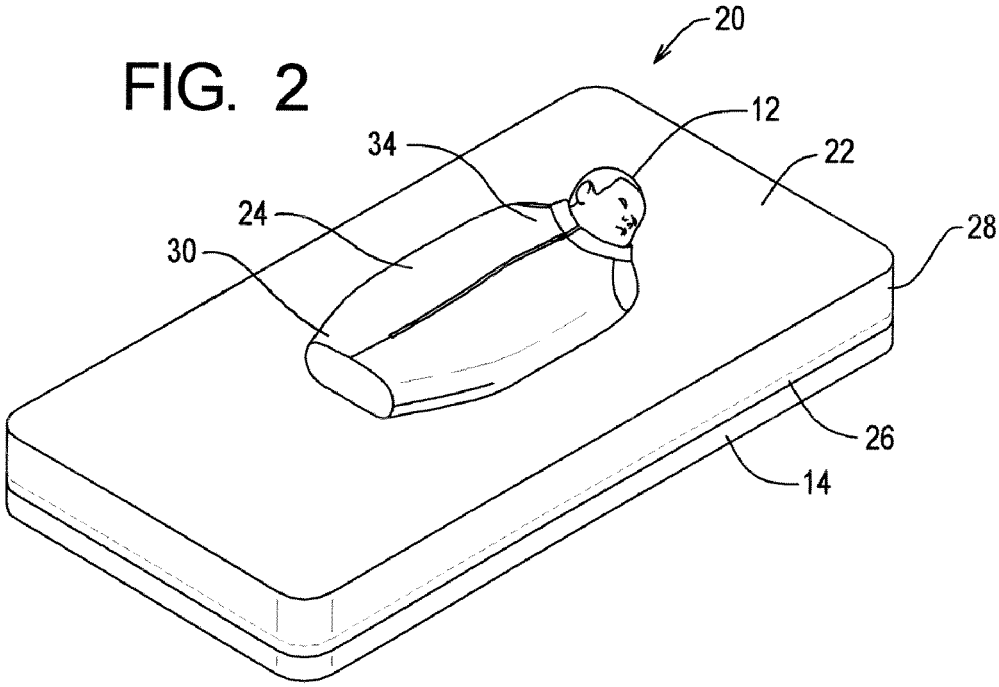
FIG. 2 is a perspective view of the young child's sleeping pouch.

Referring to FIGS. 1 and 2, the resting assembly 20 is installed on top of a mattress 14 placed within the crib 16. While a crib 16 is shown, other child resting devices can be utilized including but not limited to: a changing table; a mattress; bed; stroller; jogger; a daybed, or travel crib.

Figure 3:
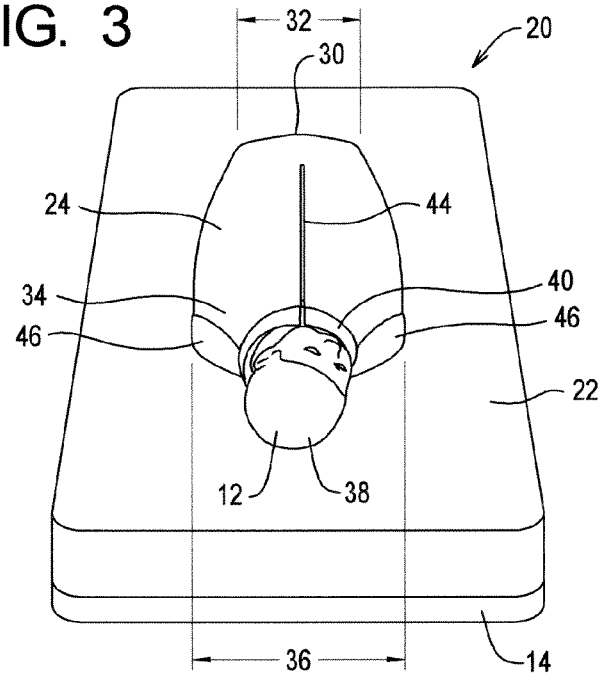
FIG. 3 is a perspective view of the young child's sleeping pouch emphasizing the taped pouch configuration.
Figure 4:
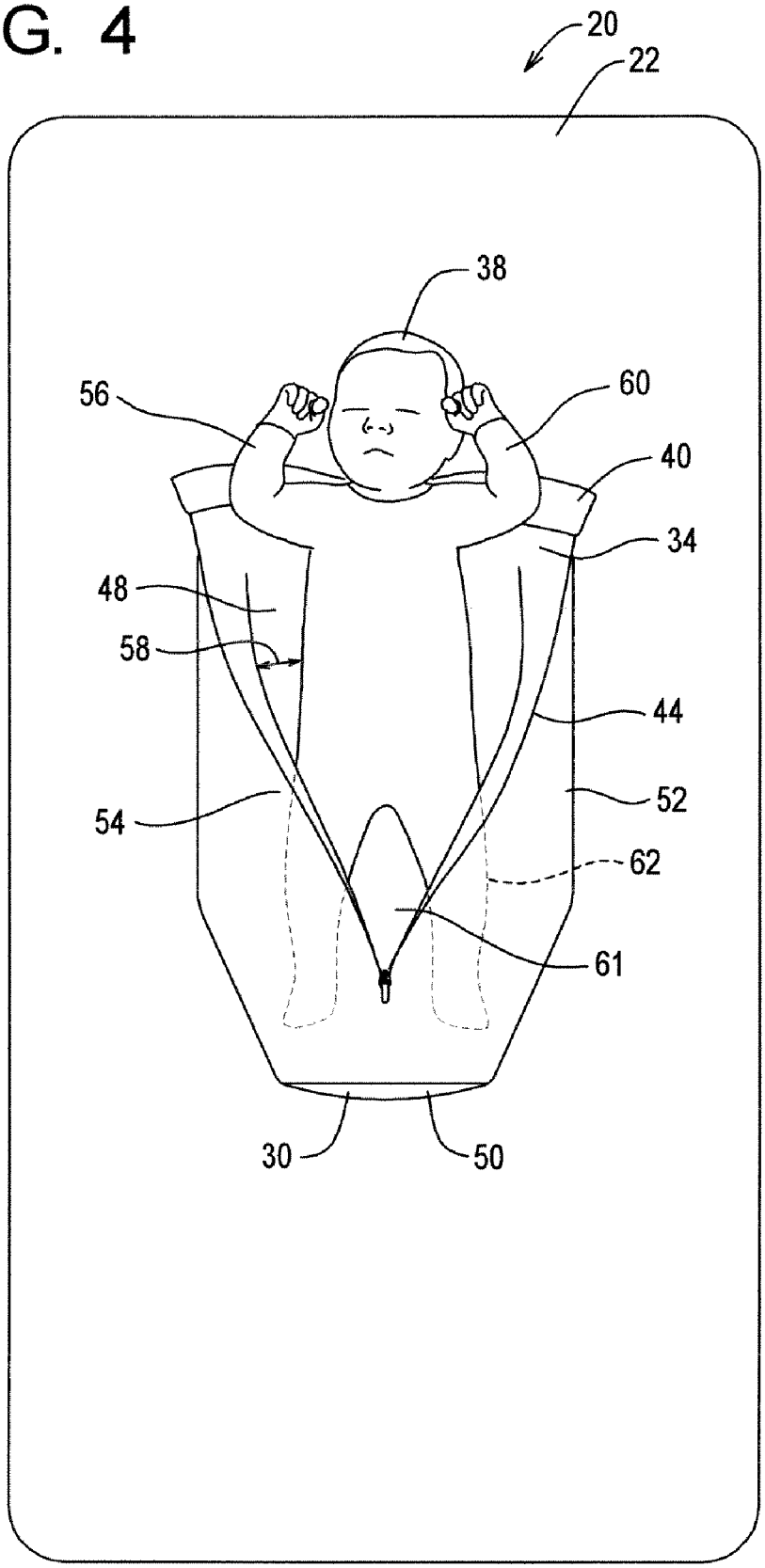
FIG. 4 is a plan view of the young child's sleeping pouch in the open position.

Referring to FIG. 2, 3 and 4, the resting assembly 20 as provided for this current embodiment is constructed of a base anchor sheet 22 and a pouch or envelope container 24.

To fit a number of different mattresses 14 which come with the various daybeds/cribs, the base anchor 22 can be constructed of various materials and/or configurations. This includes the use of a sheet or section of fabric which may include covering the entire portion or just a portion of the mattress. Securing the base anchor 22 to the mattress 14 includes different configurations such as straps, snaps to the mattress, zippers connected to the mattress, Velcro™ connectors, as well as fitted sheets or fitted blankets as used in the current embodiment. The fitted corners 28 and elastic perimeter band 26 enable the base anchor 22 to be stretched about the sides of the mattress 14 and secure reasonably well to the bottom of the mattress to avoid loosening of the base anchor during movement of the child while sleeping on the mattress or cushion.

The pouch or envelope 24 is constructed with a lower foot portion 30 and an upper torso portion 34. The pouch 24 is configured in somewhat of a trapezoidal shape, with the upper torso portion 34 having a torso width 36 which is wider than the lower foot portion 30 having a foot width 32. This slightly tapered shape from the wider torso width 36 to the narrower foot width 32 is conformed to the generally tapered shape of the child's body. By providing such a tapered trapezoidal shaped pouch 24, the child 12 is less likely to have room to leverage itself and turn over involuntarily.

Another function of the resting assembly 20 is to provide for different insulation capabilities. Thus the resting assembly 20 will utilize various types of fabrics or materials including fleece, cotton, nylon, or other suitable materials which provide for the desired environmental temperature settings. For example, a fleece-type or heavy down-type of material can be used for the resting assembly 20 if the user is a resident in a cold climate, and inversely, a light cotton sheet can be used as the construction material or fabric if the user lived in a warm climate.

Further, the fabric material is somewhat elastic in its give whereby the child can still move the appendages within the pouch 20 but in order to do so, the child will need to stretch the fabric to adjust the appendages to a different longitudinally aligned position. Also the child is restrained from overturning as discussed below.

Still referring to FIG. 2, the resting assembly 20 and in particular the pouch section 24 can be provided for varying sizes depending on the age of the newborn, infant or toddler. Generally speaking, the size range of children from the ages of 0 to 24 months will vary depending on the specific monthly age of the child. For example, newborns are generally thought to be between the ages of 0 to 9 months. The clothing industry has sized the clothing according to age ranges of three months. This includes the first age range of 0 to 3 months for a size range of 0 to 23 inches; next is the 3 to 6 month age range with a size range of approximately 23 to 25 inches; then the 6 to 9 months age range with a size range of 25 to 27 inches in length.

Infants are the age category just after the newborns. The infant age and sizes correlate as follows: 9 to 12 months correlates to 27 to 29 inches in length; 12 to 18 months correlates to 29 to 31 inches in length; 18 to 24 months correlates to 31 to 33 inches in length.

Toddlers are the age category just after infants and generally range from age 2 to 4 years old. Generally speaking, toddlers have developed far enough along so that their breathing pathways do not need to be protected from dangerous carbon monoxide rebreathing because they have enough strength to create fresh air channels for breathing during sleeping. But, some of the larger infants as well as some of the younger toddlers may still use the resting assembly 20 so size accommodations are readily conceived of for these children as well.

The current embodiment provides for various sizes based on the above-mentioned age ranges. In particular, and referring to FIG. 8A, the longitudinal pouch distance 210 of the resting assembly 20 is proportioned to about the same length of the newborn or infant for the various size ranges as previously discussed.

Figure 8A:
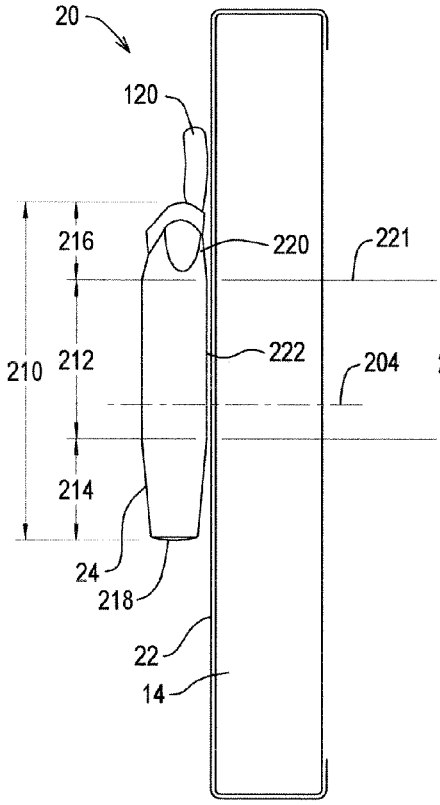
FIG. 8A is a side elevational view of the young child's resting pouch.
Figure 8B:
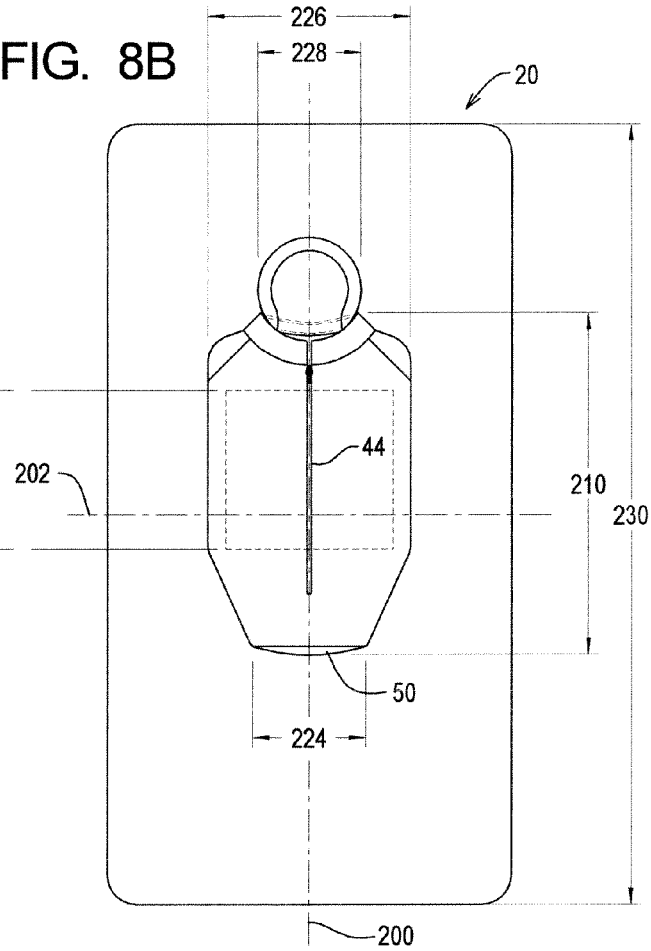
FIG. 8B is a plan view of the young child's resting pouch.

As mentioned above, one element of the current embodiment is to provide for restraint of the appendages within the transverse direction 202 as seen in FIG. 8B, while allowing some vertical translational movement of the lower and upper extremities, for example, the legs, the upper torso portion (shoulders and/or neck). With that in mind, and referring to FIG. 8A, the pouch section 24 has a secured medial longitudinal portion 222 where the pouch section 24 is secured to the base anchor section 22. This secured medial longitudinal portion 222 is positioned so that as an upper limit, no greater than about ½ of the overall longitudinal pouch distance 210 is secured to the base anchor section 222 at one time. This allows the rest of the pouch section 24 to be movable somewhat within a transverse direction as well as translatable in a vertical direction. This translation includes as previously discussed a movable lower longitudinal portion 218 as well as a movable upper longitudinal portion 220. Furthermore, from a proportional standpoint, the lower movable longitudinal portion distance 214 of the movable lower longitudinal portion 218 ranges from about less than or equal to ½ of the overall longitudinal portion distance 210. Along the same lines, the upper movable longitudinal portion distance 216 ranges from about less than or equal to ⅓ of the overall longitudinal portion distance 210.

With regard to the overall width of the pouch section 24, or in other words the torso transverse distance 226 as seen in FIG. 8B, the torso transverse distance 226 is about less than or equal to ½ of the overall longitudinal pouch distance 210 as seen in FIG. 8A. Similarly, the lower movable portion transverse distance 224 of the pouch bottom wall 50 is about less than or equal to ⅔ of the torso transverse distance 226.

Figure 3A:
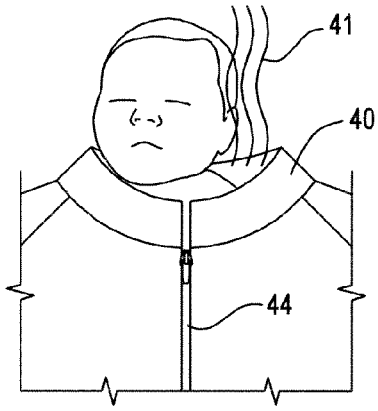
FIG. 3A is a plan view of the young child's head projecting out of the pouch.

Referring back to the construction of the resting assembly 20, the pouch itself has in the current embodiment a pouch collar 40 which is seen in FIG. 3 and 4 with a semi cylindrical shape providing for support of the child's neck as well as insulation around the neck portion of the child. Generally speaking, the head and neck will extend out of the upper torso portion 34 allowing for dissipation of heat, as seen in FIG. 3A, from the interior of the pouch or envelope 24 so that the child can regulate heat loss.

Figure 3B:
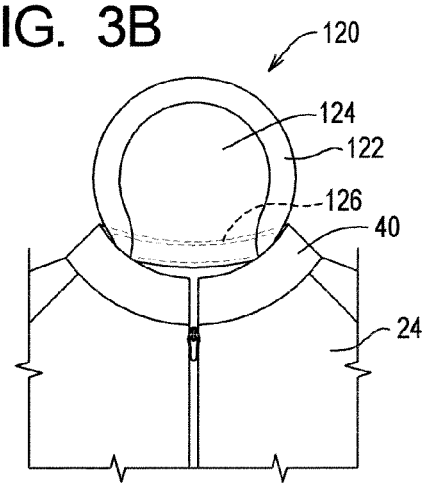
FIG. 3B is a plan view of the head rest cushion attached to the pouch.

Sometimes the skull has not developed adequately enough in the rear portion of the head and the child may have need of a support or headrest cushion 120 so as to avoid flattening back the head. Referring to FIG. 3B, a headrest cushion 120 is attached to the pouch collar 40 through the use of an attachment 126 which in the current embodiment is a Velcro or hook and loop-type fastener. In addition to Velcro, a zipper or snaps and/or buttons could be used to attach the headrest cushion 120 to the pouch collar 40. The headrest cushion is constructed of in the current embodiment a cylindrical cushion 122 which provides for the support of the head around the perimeter of the head leaving the back of the head reasonably unsupported so that the child's head does not become flattened. The headrest also has a headrest back wall 124 which essentially closes off the semicircular opening of the headrest. The headrest back wall 124 also acts as the shape configuration which the headrest cushion or headrest cylindrical cushion 122 is attached to.

Providing additional width around the shoulders of the child 12, the upper torso portion 34 has pouch shoulder cups 46 symmetrically placed on either side of the upper torso portion allowing for some additional room for the child to move back and forth and make minor position changes while lying on its back and encased within the pouch 24. In this current embodiment, the envelope or pouch as previously discussed has a lower foot portion 30 which is constructed of a bottom pouch wall 50, the upper portions or the torso portion 34 is constructed of pouch sidewalls 52 and pouch front wall 54. Bisecting the pouch front wall 54 is a closure mechanism 44, which in this current embodiment is a zipper. Other closure mechanisms can be used including buttons, snaps, and closed loop or Velcro™-type securing mechanisms.

Referring to FIG. 4, the current embodiment shows the pouch front wall 54 in its open position with the child 12 being inserted into the inner region or inner volume 61 of the pouch 24.

Figure 5A:
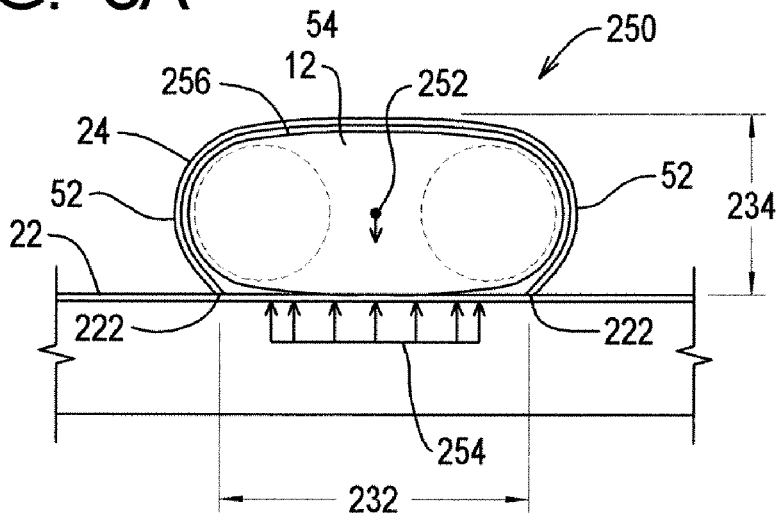
FIG. 5A is a cross-sectional view of the young child's sleeping pouch containing the young child in a resting position.

Referring now to FIGS. 5 and 5A, discussion of the resting assembly in its resting position and its restraining positions will now be provided. Referring first to FIG. 5A, the resting assembly resting position 250, includes a pouch section 24 which includes the two sidewalls 52 and the front wall 54. The young child 12 has a center of gravity 252 which is aligned in the longitudinal direction. The pouch section 24 is secured to the base anchor section 22 along the perimeter of the secured medial longitudinal position 222. The secured medial transverse portion 232 includes the base width of the pouch section 24 while the young child 12 is contained within the interior volume 61 of the pouch section 24. While lying on its back, the young child 12 will present a distributed load 254 onto the base section and cushion which is defined by area of the lying position and is in a uniform pound per square inch load, or linearly in pounds per linear inch. In the resting position 250, the pouch section 24 is in substantial contact with the outer surface area 256 of the young child 12 or alternatively with the child's clothing being worn in the pouch.

Figure 5B:
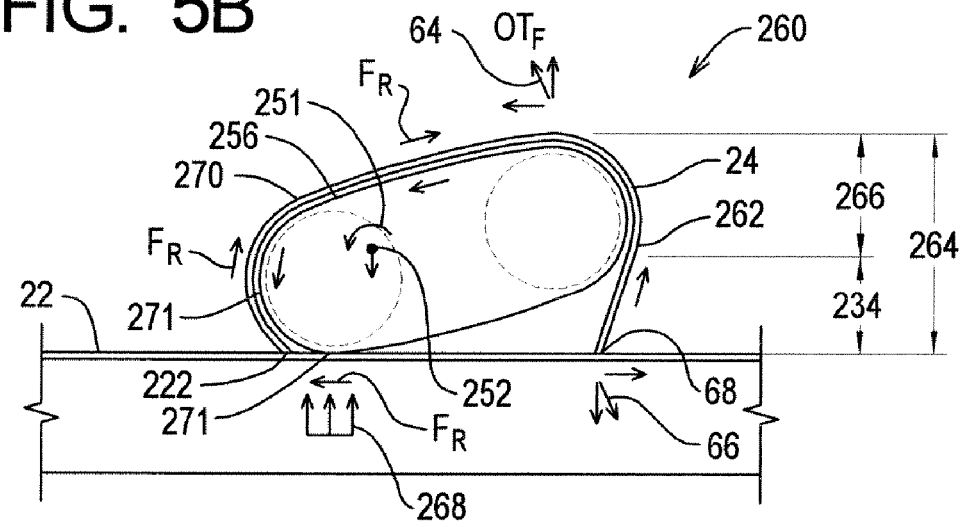
FIG. 5B is a cross-sectional view of the young child's sleeping containing the young child in a restraining position.

While the child is resting, and referring to FIG. 5B, the child may desire to turn over from its back prone position onto a front or side prone position. The child may leverage itself about the longitudinal axis and about its center of gravity 252 and create an overturning moment 251. The pouch section 24 will engage the young child 12 in the pouch restraining position 260. In this scenario, the overturning force 64 of the outer portions of the child will be counteracted by a restraining pouch wall portion 262 which is elastically stretched a distance 266 beyond the average vertical pouch wall distance 234. This stretching puts tension into the restraining pouch wall portion 262, the tension transferred to an anchor point 68 positioned along the perimeter of the secured medial longitudinal portion 222. At this anchor point 68, an anchor resisting force 66, having a horizontal and a vertical component, will transfer the tensioned force in the pouch wall portion 262 into the base section 22. As the young child 12 turns over or attempts to turn over, the center of gravity 252 shifts somewhat and a higher localized or redistributed uniform load 260 is applied to the base section 22. A higher pound per linear inch load is applied and consequently, a greater frictional resistance between the outer surface area 256 of the child and the base section 22 is provided along a shorter linear distance.

Furthermore, because the pouch section 24, including the front wall 54 and the side wall 52 not in tension, is already in contact with the outer surface area 256 of the young child 12, frictional resistance occurs along the surface area and helps to restrain the overturning moment, 254. This occurs within the frictional engagement pouch wall portion 270 which encompasses the portion of the pouch section 24 which maintains contact with the surface area 256 of the young child.

Thus, the overall frictional resistance portion 271 includes the frictional engagement pouch wall portion 270 and the redistributed uniform load 260 area.

Figure 8C:
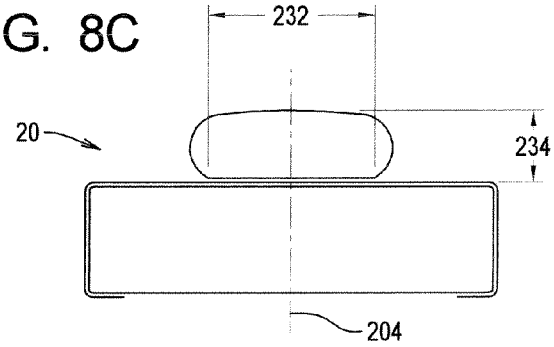
FIG. 8C is an end elevational view of the young child's sleeping pouch.

To provide for additional resistance and rigidity, the pouch back wall 48 as seen in FIG. 4, the perimeter of which is delineated by the secured medial longitudinal portion distance 212 as seen in FIG.8, and the secured medial transverse portion distance 232 as seen in FIG.8C, can be provided in an alternative embodiment with a more rigid type construction such as a thick canvass-type material, a leather-type material, or a poly vinyl or plastic-type material which provides some rigidity of the back wall when resisting overturning moment or the resultant overturning force as previously discussed.

In addition to utilizing the pouch section 24, the resting assembly 20 also can optionally include a swaddling blanket of varying sizes and proportions. After the child has been swaddled in the blanket, the child is placed within the pouch 24 and restrained even further from movement and also is provided a secure and safe environment.

Figure 6:
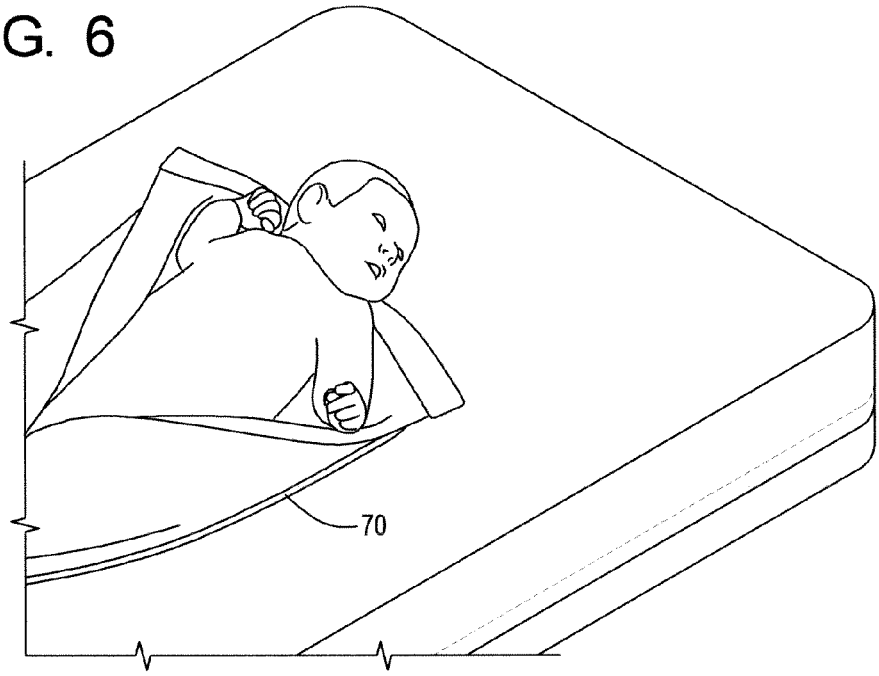
FIG. 6 is a perspective detail view of the young child's sleeping pouch envelope connected to the young child's sleeping pouch anchor base.

To secure the resting envelope 24 to the base anchor sheet 22, a number of anchoring devices connecting the perimeter of the envelope side wall 52 to the desired location on the base anchor sheet 22 can be provided. In the current embodiment as seen in FIG. 6, the envelope 24 is stitched to the base anchor sheet 22 around the perimeter of the envelope. Additional anchoring points or anchoring embodiments include zippers, Velcro™ strips, snaps, or other securing elements, allowing the pouch portion 20 to be removable from the base sheet and still keeping the child contained therein.

Figure 7:
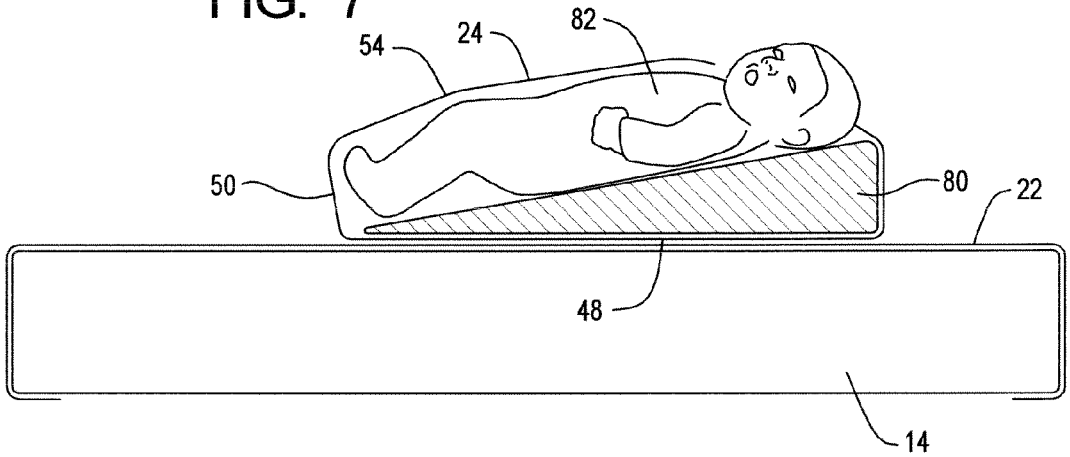
FIG. 7 is a cross-sectional view of the young child's sleeping pouch holding a young child.

Many times newborns have what is referred to as colic, which is aggravated by an undeveloped flap between the stomach portion of the newborn stomach and the esophagus. When this flap is underdeveloped or hasn't obtained its rigidity, stomach acids after feeding will become volatile and enter into the bottom portion of the esophagus. This provides the child 12 with some form of significant discomfort. Thus the child needs to be placed on a relatively steep incline to keep the acids in the stomach towards the bottom of the child's stomach region and away from the underdeveloped flap in the lower portion of the esophagus. Many times the parents will place the child on a foam incline 80 as seen in FIG. 7 to keep the child with the colic 82 in an inclined position. Placement of the incline into the pouch along with the infant will secure the child in the desired position. This placement keeps the child from falling off the incline. To provide for sliding resistance, the envelope bottom wall 50 supports the infants legs 62 and the infant is thus kept in the inclined position during rest.

A discussion of the method of use of the current embodiments will now be provided. Referring to FIG. 1, the user will choose the desired child sleeping environment 10 which may be a crib, a bassinet, changing table, a mattress, a travel crib, and other previously mentioned sleeping locations. The user will install the infant resting assembly 20 onto the cushion or mattress of the crib, for example, by utilizing the attachment portion of the base section 22 (as seen in FIG. 2). As previously mentioned, the attachment portion will be secured through elastic means, straps, snaps, or other securing device which is readily available. The user will then prepare the pouch section 24 for insertion of the child into the pouch by opening the pouch section utilizing the zipper, snaps, or Velcro -type closure mechanism. The child will be inserted on his or her back in the envelope 24. The parent will then remove any loose bedding from the area of the child's breathing space to prevent rebreathing of harmful carbon dioxide and prevention of SIDS.

In the alternative, during the installation of the resting assembly 20, the anchor section or base section 22 may be installed but the pouch section 24 may not be installed because the user may have purchased a different size, or need to install a different fabric-type envelope 24. In such a situation, the anchor section will be installed first as previously discussed and then the envelope portion 24 will be connected to the anchor section through the use of the previously mentioned perimeter securing mechanism about the secured medial longitudinal portion 222, as previously discussed in FIGS. 8A, 8B, and 8C. The closure mechanism will include the buttons, zippers, snaps, or Velcro™ hook and loop-type fastener.

Also in the alternative, the user may wish to insert the incline 80 as previously seen in FIG. 7 for a child which is experiencing colic. Similarly, the user may wish to swaddle the child in a blanket prior to insertion in the envelope 24. Lastly, the user may wish to install the headrest as seen in FIG. 3B for children which have soft patches on the back of their heads. Once these alternative options have been completed, the user can then insert the child into the envelope, securing the child for resting.

I claim:

1. A young child resting apparatus, said resting apparatus comprising:

a. a base section arranged along a longitudinal and transverse plane, said base section comprising a material to cover and attach to a cushion within a resting environment;

b. said base section further comprising a medial attachment location positioned about center of said longitudinal and transverse plane and a pouch section secured to said base section at said medial attachment location;

c. said pouch section comprising a child resting arrangement, said child resting arrangement comprising a containing wall comprised of a pouch material to contain said young child in a back prone resting position along a longitudinal axis of said longitudinal and transverse plane, said containing wall comprising an interior volume to substantially match the young child's exterior surface area and configured to substantially maintain said child's appendages in substantially longitudinal alignment with said child's body;

d. said pouch section further comprising a child restraining arrangement configured to restrain said child during an overturning action from said back prone resting position about said longitudinal axis, said child restraining arrangement comprising a first restraining wall portion comprising a first portion of said containing wall placed in tension and comprising a first anchor location along a perimeter portion of said medial attachment location, a frictional engagement wall portion comprising a second portion of said containing wall placed in contact with said child surface area and frictionally resisting said overturning action of said young child about said longitudinal axis.

2. The apparatus according to claim 1 wherein said pouch section further comprises a longitudinal containment length to fully contain said young child from the child's neck to the child's feet.

3. The apparatus according to claim 2 wherein said longitudinal containment length is configured for said young child as a newborn.

4. The apparatus according to claim 2 were in said longitudinal containment length is configured for said young child as an infant.

5. The apparatus according to claim 2 for said longitudinal containment length is configured for said young child as a toddler.

6. The apparatus according to claim 2 were in said longitudinal containment length for said young child as a newborn further comprises: a three-month size for a newborn about 0 inches to about 23 inches in length; a three to six-month size for a newborn about 23 inches to about 25 inches in length; a six to nine month size for a newborn about 25 inches to about 27 inches in length.

7. The apparatus according to claim 2 wherein said longitudinal containment length for said young child as an infant further comprises: a nine to twelve month size for an infant about 27 inches to about 29 inches in length; a twelve to eighteen month in size for an infant about 29 inches to about 31 inches in length; an eighteen to twenty-four month in size for an infant about 31 inches to about 33 inches in length.

8. The apparatus according to claim 2 wherein said medial attachment location further comprises a medial attachment perimeter having two equal but opposite medial side attachment lengths arranged in the longitudinal direction, a forward medial transversely aligned length and a rearward medial transversely aligned length, said medial side attachment lengths no greater than one half of said longitudinal containment length.

9. The apparatus according to claim 8 wherein said pouch section further comprises a lower region, a medial region, and an upper region.

10. The apparatus according to claim 9 wherein said medial region further comprises a medial longitudinal length no greater than about one half of said longitudinal containment length.

11. The apparatus according to claim 10 wherein said medial region further comprises a medial base wall which substantially matches said medial attachment location.

12. The apparatus according to claim 11 wherein said medial base wall attaches to said medial attachment location along said medial attachment perimeter.

13. The apparatus according to claim 12 wherein said medial base wall and medial attachment location are connected together along said medial attachment perimeter by one or more of the following attachment mechanisms: threaded stitching, zippers, hook and loop type faster, buttons, and snaps.

14. The apparatus according to claim 8 wherein said lower region ranges in longitudinal distance from no greater than about one half of said longitudinal containment length.

15. The apparatus according to claim 14 wherein said lower region of said pouch section further comprises a lower base wall connected to said medial attachment location along said rearward medial transversely aligned length of said medial attachment perimeter.

16. The apparatus according to claim 15 wherein said lower region of said pouch section is configured to allow said young child's legs a range of vertical and transverse movement while maintaining said young child's legs in substantial alignment with one another.

17. The apparatus according to claim 8 wherein said upper region ranges in longitudinal distance from no greater than about one third of said longitudinal containment length.

18. The apparatus according to claim 17 wherein said upper region of said pouch section further comprises an upper base wall connected to said medial attachment location along said forward medial transversely aligned length of said medial attachment perimeter.

19. The apparatus according to claim 18 wherein said upper region of said pouch section is configured to allow said young child's upper torso a range of vertical and transverse movement.

20. The apparatus according to claim 1 wherein said pouch section further comprises one or more of the following materials: cotton, fleece, polyester, nylon, or a combination thereof.

21. The apparatus according to claim 1 wherein said base section further comprises a fitted sheet.

22. The apparatus according to claim 1 wherein said base section further comprises a fitted blanket.

23. The apparatus according to claim 1 wherein said base section further comprises a blanket having transversely aligned straps to secure underneath said cushion.

24. The apparatus according to claim 1 for in said the base section further comprises a sheet having transversely aligned straps to secure underneath said cushion.

25. The apparatus according to claim 1 wherein said base section further comprises a blanket having snaps equidistantly spaced about the perimeter of said blanket to connect to snap receivers on said cushion.

26. The apparatus according to claim 1 wherein said base section further comprises one or more of the following materials: cotton, fleece, polyester, nylon, or combination thereof.

27. The apparatus according to claim 1 wherein said cushion further comprises a mattress for one or more of the following: a crib, changing table, bassinet, bed, stroller, travel crib, jogger.

28. A young child or resting apparatus, said resting apparatus comprising:

a. a base section comprising a fitted fabric material arranged along a longitudinal and transverse plane, said fitted fabric material configured to cover a mattress within a crib, said fitted fabric material further comprising an elastic perimeter band to attach to said mattress;

b. a pouch section connected to said base section central of said longitudinal and transverse plane, said pouch section further comprising a containing wall comprised of a pouch fabric material to contain said young child in a back prone position, said containing wall and said young child arranged along a longitudinal axis of said longitudinal and transverse plane, said containing wall comprising an interior volume to substantially match an exterior surface area of said young child, and configured to substantially maintain said young child's appendages in substantial longitudinal alignment with said young child's body;

c. said pouch section further configured to restrain said young child during an overturning action by said child from said back prone position about said longitudinal axis, said containing wall further comprising: a first restraining wall portion; a first overturning force location; a first anchor location positioned along a connection edge between said pouch section and said base section, said first restraining wall portion configured to transmit an overturning force applied to said first overturning force location in tension to said base section;

d. said containing wall further comprising a frictional engagement wall portion in contact with said exterior surface area of said young child and frictionally resisting said overturning action of said young child about said longitudinal axis;

e. said pouch section further comprising a longitudinal containment length to fully contain said young child from the young child's neck to the child's feet; said longitudinal containment length for said young child further comprising: a three month size for a newborn about zero to twenty-three inches in length; a three to six month size for a newborn about twenty-three to twenty-five inches in length; a six to nine month size for a newborn about twenty-five to twenty-seven inches in length; a nine to twelve month size for an infant about twenty-seven to twenty-nine inches in length; a twelve to eighteen month size for an infant about twenty-nine to thirty-one inches in length; an eighteen to twenty-four month size for an infant about thirty-one to thirty-three inches in length;

f. said pouch section further comprising a lower region, a medial region, and an upper region;

g. said medial region further comprising a medial longitudinal length no greater than about one-half of said longitudinal containment length; said pouch section connected to said base section about said medial region;

h. said lower region ranging in longitudinal distance from no greater in length than about one-half of said longitudinal containment length; said lower region of said pouch section further comprising a lower base wall connected to a longitudinally lower intersection between said medial region and said base section, said lower region of said pouch section configured to allow said young child's legs a range of vertical and transverse movement while maintaining said young child's legs in substantial alignment with one another.

29. A young child resting assembly, said assembly comprising:

a. a resting structure comprising a plurality of support members vertically aligned and each support member further comprising a ground engaging end and a platform support end, said platform support end supporting a resting platform;

b. said resting platform configured to support a cushion; said cushion and said resting platform configured within a longitudinal and transverse plane; said cushion further comprising a removable base section, said base section comprised of a material to cover and attach to said cushion placed on said resting platform supported by said resting structure support members;

c. said base section further comprising a medial attachment location positioned about center of said longitudinal and transverse plane and a pouch section secured to said base section at said medial attachment location;

d. said pouch section comprising a child resting arrangement, said child resting arrangement comprising a containing wall comprised of a pouch material to contain said young child in a back prone resting position along a longitudinal axis of said longitudinal and transverse plane, said containing wall comprising an interior volume to substantially match the young child's exterior surface area and configured to substantially maintain said child's appendages in substantially longitudinal alignment with said child's body;

e. said pouch section further comprising a child restraining arrangement configured to restrain said child during an overturning action from said back prone resting position about said longitudinal axis, said child restraining arrangement comprising a first restraining wall portion comprising a first portion of said containing wall placed in tension and comprising a first anchor location along a perimeter portion of said medial attachment location, a frictional engagement wall portion comprising a second portion of said containing wall placed in contact with said child surface area and frictionally resisting said overturning action of said young child about said longitudinal axis.

30. A method for placing a child at rest, said method comprising:

a. placing onto a cushion within a resting environment a base section arranged along a longitudinal and transverse plane;

b. attaching a pouch section to said base section onto a central medial attachment location of said longitudinal and transverse plane;

c. placing a young child on its back within the pouch section, said pouch section comprising a containing wall constructed of a containing material to contain said young child in a back prone position along a longitudinal axis of said longitudinal and transverse plane;

d. sizing said containing wall for an interior volume to substantially match said young child having an exterior surface area;

e. maintaining said child's appendages in a substantially longitudinal alignment with said child's body by maintaining said containing wall in contact with said young child's exterior surface area;

f. preventing an overturning action by said young child from said back prone position about said longitudinal axis by:

i. utilizing a first portion of said containing wall as a first restraining wall portion and placing said first restraining wall portion in tension;

ii. transmitting said first restraining wall portion in tension to a first anchor location along a perimeter portion of said medial attachment location;

iii. resisting said overturning action through frictional engagement of said containing wall placed in contact with said young child surface area.

31. The method according to claim 30 wherein said method further comprises: containing said young child within said pouch section, said pouch section having a longitudinal containment length to fully contain said young child from the child's neck to the child's feet.

32. The method according to claim 31 wherein said method further comprises: providing said longitudinal containment length for said young child as a newborn.

33. The method according to claim 31 wherein said method further comprises: providing said longitudinal containment length for said young child as an infant.

34. The method according to claim 31 wherein said method further comprises: providing said longitudinal containment length for said young child as a toddler.

35. The method according to claim 31 were in said longitudinal containment length for said young child as a newborn further comprises: a three-month size for a newborn about 0 inches to about 23 inches in length; a three to six-month size for a newborn about 23 inches to about 25 inches in length; a six to nine month size for a newborn about 25 inches to about 27 inches in length.

36. The method according to claim 31 wherein said longitudinal containment length for said young child as an infant further comprises: a 9 to 12 month size for an infant about 27 inches to about 29 inches in length; a 12 to 18 month in size for an infant about 29 inches to about 31 inches in length; an 18 to 24 month in size for an infant about 31 inches to about 33 inches in length.

37. The method according to claim 31 wherein said central medial attachment location further comprises a medial attachment perimeter having two equal but opposite medial side attachment lengths arranged in the longitudinal direction, a forward medial transversely aligned length and a rearward medial transversely aligned length, said medial side attachment length no greater than one half of said longitudinal containment length.

38. The method according to claim 37 wherein said pouch section further comprises a lower region, a medial region, and an upper region.

39. The method according to claim 38 wherein said medial region further comprises a medial longitudinal length no greater than about one half of said longitudinal containment length.

40. The method according to claim 39 wherein said medial region further comprises a medial base wall which substantially matches said medial attachment location.

41. The method according to claim 40 wherein said medial base wall attaches to said medial attachment location along said medial attachment perimeter.

42. The method according to claim 40 wherein said medial base wall and medial attachment location are connected together along said medial attachment perimeter by one or more of the following attachment mechanisms: threaded stitching, zippers, hook and loop type faster, buttons, and snaps.

43. The method according to claim 38 wherein said lower region ranges in longitudinal distance from no greater than about one half of said longitudinal containment length.

44. The method according to claim 43 wherein said lower region of said pouch section further comprises a lower base wall connected to said medial attachment location along said rearward medial transversely aligned length of said medial attachment perimeter.

45. The method according to claim 44 wherein said lower region of said pouch section is configured to allow said young child's legs a range of vertical and transverse movement while maintaining said young child's legs in substantial alignment with one another.

46. The method according to claim 38 wherein said upper region ranges in longitudinal distance from no greater than about one third of said longitudinal containment length.

47. The method according to claim 46 wherein said upper region of said pouch section further comprises an upper base wall connected to said medial attachment location along said forward medial transversely aligned length of said medial attachment perimeter.

48. The method according to claim 46 wherein said upper region of said pouch section is configured to allow said young child's upper torso a range of vertical and transverse movement.

49. The method according to claim 30 wherein said pouch section further comprises one or more of the following materials: cotton, fleece, polyester, nylon, or a combination thereof.

50. The method according to claim 30 wherein said base section further comprises a fitted sheet.

51. The method according to claim 30 wherein said base section further comprises a fitted blanket.

52. The method according to claim 30 wherein said base section further comprises a blanket having transversely aligned straps to secure underneath said cushion.

53. The method according to claim 30 wherein said the base section further comprises a sheet having transversely aligned straps to secure underneath said cushion.

54. The method according to claim 30 wherein said base section further comprises a blanket having snaps equidistantly spaced about the perimeter of said blanket to connect to snap receivers on said cushion.

55. The method according to claim 30 wherein said base section further comprises one or more of the following materials: cotton, fleece, polyester, nylon, or combination thereof.

56. The method according to claim 30 wherein said cushion further comprises a mattress for one or more of the following: a crib, changing table, bassinet, bed, stroller, travel crib, jogger.

57. A young child resting apparatus said apparatus comprising:

a. means for securing onto a cushion within a resting environment a base section arranged along a longitudinal and transverse plane;

b. means for attaching a pouch section to said base section onto a central medial attachment location of said longitudinal and transverse plane;

c. means for securing a young child on its back within the pouch section, said pouch section comprising a containing wall constructed of a containing material to contain said young child in a back prone position along a longitudinal axis of said longitudinal and transverse plane;

d. means for matching said containing wall substantially to match said young child's exterior surface area;

e. means for maintaining said young child's appendages in a substantially longitudinal alignment with said child's body by maintaining said containing wall in contact with said young child's exterior surface area;

f. means said pouch section further comprising for preventing an overturning action by said young child from said back prone position about said longitudinal axis.

* * * * *